US005751821A

United States Patent [19]

Smith

[11] Patent Number: 5,751,821

[45] Date of Patent: May 12, 1998

[54] SPEAKER SYSTEM WITH RECONFIGURABLE, HIGH-FREQUENCY DISPERSION PATTERN

[75] Inventor: David L. Smith, Binghamton, N.Y.

[73] Assignee: McIntosh Laboratory, Inc., Binghamton, N.Y.

[21] Appl. No.: 141,369

[22] Filed: Oct. 28, 1993

[51] Int. Cl.[6] ..... H04R 5/00

[52] U.S. Cl. ..... 381/90; 381/24

[58] Field of Search ..... 381/24, 88, 90, 381/97, 182, 188, 205

[56] References Cited

U.S. PATENT DOCUMENTS

| | | | |
|---|---|---|---|
| 3,824,343 | 7/1974 | Dahlquist | 381/24 |
| 4,165,797 | 8/1979 | Spetalnik | 181/147 |
| 4,182,429 | 1/1980 | Senzaki | 181/144 |
| 4,696,037 | 9/1987 | Fierens | 381/24 |
| 4,860,363 | 8/1989 | Suzuki et al. | 381/90 |
| 4,884,655 | 12/1989 | Freadman et al. | 181/145 |
| 4,953,223 | 8/1990 | Householder | 381/90 |
| 4,991,687 | 2/1991 | Oyaba et al. | 381/90 |
| 5,148,490 | 9/1992 | Draffen | 381/90 |

*Primary Examiner*—Edward L. Coles, Sr.
*Assistant Examiner*—Stephen Brinich
*Attorney, Agent, or Firm*—Salzman & Levy

[57] ABSTRACT

The present invention features a high-quality audio frequency loudspeaker system utilizing an array of tweeters placed in vertical alignment along an axis. The tweeter array, containing a plurality of tweeters, is mounted on a tweeter baffle board which may be reoriented by a user, so that the speaker system may be positioned in either a horizontal or a vertical orientation relative to the floor or other supporting surface. Reorientation of the tweeter array, in conjunction with other novel features, allows the speaker system to meet horizontal and vertical radiation pattern specifications for home theaters.

22 Claims, 4 Drawing Sheets

SPEAKER SYSTEM WITH RECONFIGURABLE, HIGH-FREQUENCY DISPERSION PATTERN

FIELD OF THE INVENTION

The present invention pertains to loudspeaker systems for high-fidelity sound reproduction, and, more particularly, to high-quality, reconfigurable loudspeaker systems for use in theater installations in the home and the like.

BACKGROUND OF THE INVENTION

In the field of audio frequency sound reproduction, numerous attempts have been made to create loudspeaker systems having both a wide and a smooth frequency response characteristic in the response range of the human ear (approximately between 20 Hz and 20 kHz).

In loudspeakers of typical dimensions, low-frequency range sound (i.e., sound having frequencies below 1 kHz) is essentially non-directional and high-frequency range sound highly directional, with the degree of directionality being generally proportional to the frequency. Heretofore, then, the spatial relationship of a listener to one or more speakers in a sound-reproduction system determined the effective perceived frequency response of the reproduction system. Generally, the ideal spatial relationship of a listener to a speaker system is orthogonal to the speaker's face. High frequencies tend to diminish as a listener moves off-axis from that position. Designers of speakers have expended considerable effort in creating systems that have satisfactory, high-frequency radiation (dispersion) patterns, even many degrees off-axis.

The overall frequency response of a speaker system is highly dependent upon the acoustical environment in which it is placed. Room geometry; absorptive characteristics of floor, ceiling and walls; the presence and absorptive characteristics of furniture in the room; and speaker location all greatly influence the perceived frequency response of a speaker system. In a two-channel stereo system employing a pair of speakers, the ideal listening position is centered between, and several feet in front of, the pair of speakers, with each speaker being angled inward towards the listener in order to maintain the integrity of the orthogonal relationship between listener and speakers.

The positioning of speakers angled away from a wall in a listening room, however, has proven to be aesthetically unpleasing to some. Designers have thus attempted to find other ways to control the radiation patterns of high-frequency audio sound. Many system designers have also attempted to insure broad horizontal dispersion in a room, independent of speaker placement. Such solutions allow the placement of speakers in an aesthetically pleasing manner (e.g., against a flat wall) without destroying their acoustical performance. In fact, low-frequency output from a typical speaker system is enhanced when the speaker is located against a wall.

The availability of the videocassette recorder (VCR) and the video disk player, along with advances in both projection and large-screen television receivers, have created an interest in what has come to be called "home theater". Home theater aficionados strive to maximize both video and audio quality. Unlike the ordinary system (which is predominantly music), the home-theater system must do equal justice to music, dialogue and sound effects, thus somewhat changing the requirements for the ideal home-theater audio system from normal audio.

Reverberation in a room generally adds to the recorded reverberation of the program source. This usually presents no problem when the program material is primarily musical. However, with movie soundtracks designed to reproduce a variety of acoustical environments (e.g., an acoustically-dead outdoor scene), the reverberation from a room may be detrimental. Moreover, room reverberation may reduce dialogue intelligibility. This creates a basic design conflict for the speaker designer. Broad directivity, which generally eases loudspeaker placement demands, may add musically pleasing reverberation, which can be at odds with speech intelligibility, as well as other concerns of the home-theater market.

Additionally, the range of speaker placement options in a room becomes even more limited when a large-screen image, whether projected or direct, dominates the foreground. The technology involved in speaker systems has been pushed in new directions to attempt to accommodate the requirements of home theaters.

The program source for home theater is typically either videocassettes or video disks. Videocassettes usually carry a pair of stereo soundtracks recorded, using analog techniques no different from those used for years in open-reel and audiocassette recording. That implies, in spite of noise reduction systems and the like, a limited dynamic range and frequency response characteristic. Video disks, on the other hand, carry digitally-encoded multi-channel soundtracks and, consequently, have become the medium of choice for serious film viewers in the home. Thus, even higher standards for sound reproduction equipment are now required.

Of particular interest to home-theater fans is the emergence of the THX® standard from Lucasfilm, the goal of which is to create a "no-compromise home cinema experience" (i.e., both video and audio quality comparable to that found in a state-of-the-art movie theater). The goals for the audio portion of the THX® standard (as stated in *Home THX: A No-Compromise Home Cinema Experience*, published by Lucasfilm), are "to provide clear dialogue and localization of sounds in front of the viewer, plus envelopment by sounds on the sides and behind the viewer. It also provides a flat sound response over a wide frequency range." In a modern movie theater, at least three speakers (right, center and left) are provided at the front of the theater, with additional speakers providing "surround sound" at the right and left sides thereof, disposed some distance back from the screen, toward the viewer/listener. The THX® standard imposes different standards upon speakers for use in the front of the viewing area from those providing surround-sound at the sides thereof. All discussion of THX® speaker specifications hereinafter refers solely to those portions applicable to front speakers. This standard imposes strict standards on the high-frequency radiation patterns of loudspeaker systems submitted for certification. This is necessary to ensure the clear dialogue and sound localization required by the specification.

It is an object of the present invention to produce a high-quality loudspeaker system for home-theater applications by meeting specifications (such as that of the Lucasfilm THX®) for frequency response, maximum Sound Pressure Level (SPL) output, as well as both horizontal and vertical radiation pattern requirements.

It is another object of the present invention to provide a speaker system with a broad horizontal radiation pattern, thus easing speaker placement concerns while limiting reverberation-producing reflections from the floor and ceiling by creating a narrow vertical radiation pattern in such a manner as to provide a speaker suitable for both home theater and music reproduction applications.

It is a further object of the present invention to produce a speaker system of small height, allowing its placement beneath the screen of a home theater, without forcing the screen to be raised to a height which would cause viewer discomfort or place expensive demands on ceiling height.

It is a still further object of the invention to produce a speaker system that can be reconfigured to have a small width for deployment at the right or left edge of the screen of a home theater, thus reducing viewing-room width requirements.

It would be additionally desirable from the perspectives of manufacturing and distribution to produce a single speaker system that embodies all of the aforementioned objects and that can be reconfigured easily by the user/listener for use in either a horizontal (low) or vertical configuration.

DISCUSSION OF THE RELATED ART

One speaker system is described in U.S. Pat. No. 4,165,797, issued to Spetalnik. This illustrates a system having four high-frequency speakers, pivotably mounted so that the axis of each is adjustable in relation to the front of the speaker enclosure, thus allowing the high-frequency radiation pattern of the speaker system to be tailored to the shape of the room or to the placement of the speakers therein.

Another manner of controlling the radiation pattern of high frequencies in a room is shown in both U.S. Pat. Nos. 4,182,429 (issued to Senzaki) and 4,441,557 (issued to Kurihara). In both the Senzaki and the Kurihara systems, the high-frequency speaker or tweeter is pivotably attached to the low-frequency speaker or woofer. This allows reorientation of the tweeter to the woofer, the consequent result thereby being that the high-frequency radiation pattern of the speaker(s) in a room may be aimed. No attempt is made to change horizontal versus vertical orientation or to maintain a given orientation while pivoting the bulk of the system.

Yet another system for control of high-frequency dispersion is taught in U.S. Pat. No. 4,884,655 (issued to Freadman et al), a tower-type speaker system. All speakers are arranged on a vertical axis. Plural tweeters and mid-range speaker units are mounted in a structure that is acoustically isolated from the structure housing a plurality of woofer/sub-woofer speaker units. The structure housing the tweeter/mid-range speaker units is pivotable in a horizontal plane through a predetermined range of angles, thus allowing aiming the high-frequency radiation pattern of the speaker, but without regard to the horizontal or verticality of the system. While this system also allows aiming the tweeter "beam" at the listener, there is no rotation of the system.

SUMMARY OF THE INVENTION

In accordance with the present invention, there is provided a speaker system having controlled radiation patterns. The speaker is intended for use as any one of the three front speakers in a home-theater installation and is reconfigurable by the user to meet the required frequency response and broad horizontal/narrow vertical directivity specification in either an upright or a horizontal orientation. The speaker system consists of a plurality of low/mid-frequency speaker units disposed upon a baffle board and a tweeter array disposed upon a tweeter baffle board. The user may reorient the tweeter baffle board with regard to the plural low/mid-frequency speaker units. Regardless of whether the speaker is placed in a horizontal or a vertical orientation, this allows the orientation of the tweeter array to remain constant in relation to the floor or other support thereof. The tweeter array consists of a plurality of tweeter units disposed in a linear array. Three tweeters have been chosen for the preferred embodiment.

BRIEF DESCRIPTION OF THE DRAWINGS

A complete understanding of the present invention may be obtained by reference to the accompanying drawings, when taken in conjunction with the detailed specification thereof and in which.

DESCRIPTION OF THE PREFERRED EMBODIMENT

Figure 1:
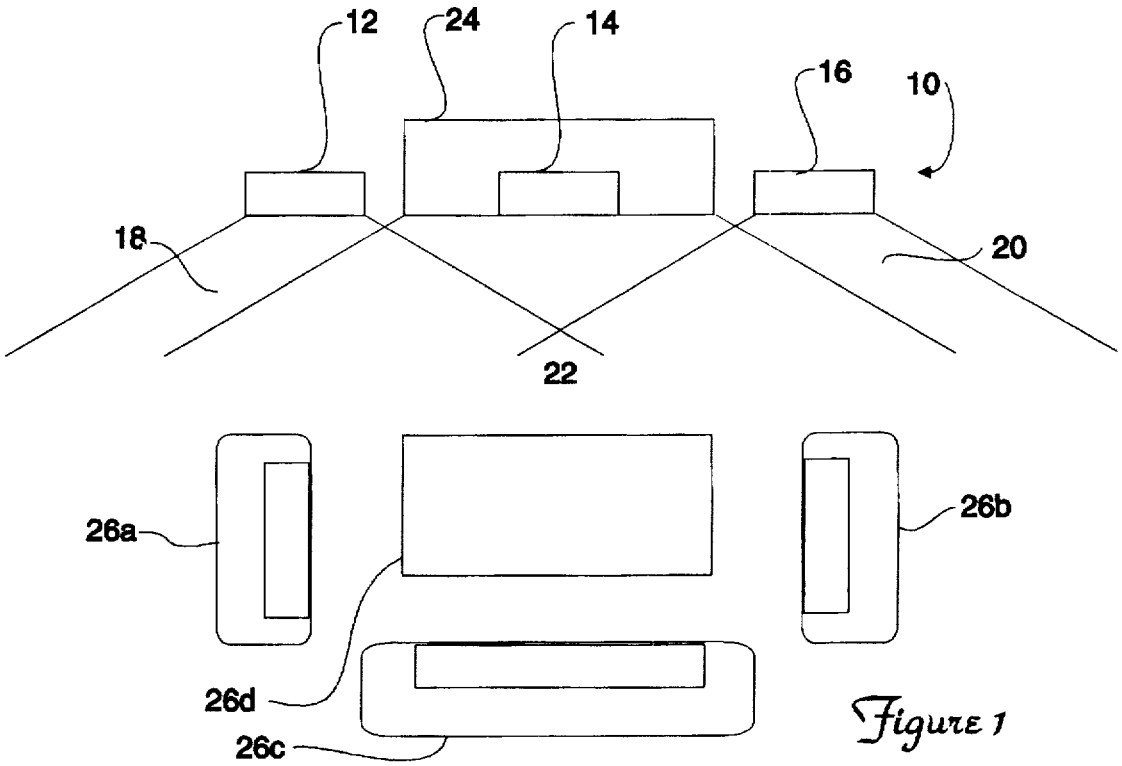
FIG. 1 is a plan view of a typical home-theater viewing area.

Referring first to FIG. 1, a plan view of a typical home-theater viewing area or room is shown generally at reference numeral 10. At the front of viewing area 10 are deployed three loudspeaker systems: left speaker 12, center speaker 14 and right speaker 16. The horizontal high-frequency radiation pattern of each speaker is shown and identified respectively by reference numerals 18, 22 and 20. Also shown, but not a part of the present invention, are a screen 24 and ancillary furniture **26*a*, 26*b*, 26*c* and 26*d***.

Figure 2:
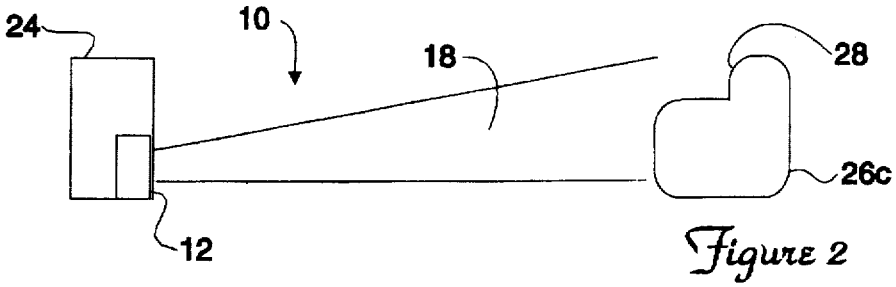
FIG. 2 is a side view of a viewer in a home-theater viewing area and shows the high-frequency radiation pattern required by the THX® specification.

Referring now to FIG. 2, there is shown a side view of viewing area 10 and a viewer 28. The high-frequency sound radiation pattern 18 from speaker system 12 illustrates the controlled dispersion needed for home theater applications in the vertical plane, typically ±15° from the horizontal axis. Identical radiation pattern characteristics are also provided by speaker systems 14 and 16 (FIG. 1), but are not shown, for ease of this description.

Figure 3:
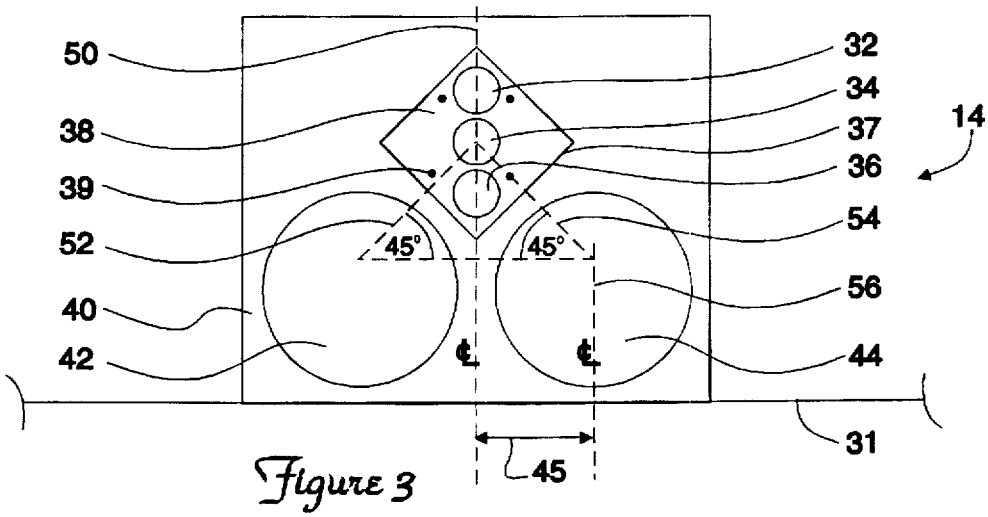
FIG. 3 is a plan view of the front of the speaker system of the present invention in a horizontal deployment.

Referring now to FIG. 3, there is shown generally at reference numeral 14 the speaker system of the present invention deployed in a horizontal orientation. Its long axis (not shown) is parallel to floor 31. Three two-inch tweeters 32, 34 and 36 (manufactured by SEAS as model number 25TAFN/G) are arranged in a linear array 37 along a vertical axis shown by phantom center line 50, normal to the plane of floor 31. Although three tweeters are shown in the preferred embodiment, it should be understood that any number of tweeters can be arranged in a linear array along an axis or center line 50 without departing from the scope of this invention. It is well known in the art to use other sound-producing components such as horns, piezo-electric transducers, electrostatic transducers, dome tweeter arrays or electrodynamic transducers as high-frequency sound sources. Tweeters 32, 34 and 36 are mounted (by screws, glue, press fit or any other suitable means well known in the art) to a tweeter baffle board 38 which is, in turn, fixedly mountable to a speaker baffle board 40. The mounting of tweeter baffle board 38 to speaker baffle board 40 is accomplished by four screws, shown typically at reference numeral 39. Screws 39 are designed for end user removal, thus allowing reorientation of tweeter baffle board 38 and tweeter array 37 mounted thereon. Sufficient slack has been provided in the connecting speaker wires (not shown) connecting tweeters 32, 34 and 36 to allow reorientation without damage to the wires. Woofer/mid-range speakers 42 and 44 (manufactured by McIntosh Laboratory, Inc., as Part Number 036103), are also fixedly attached to speaker baffle board 40. For power-handling reasons, dual eight-inch woofers are used. Both woofers are active at low frequencies, yet only one (speaker 44) operates into mid-frequencies, thus assuring no lateral interference when the speaker system is oriented with the woofers aligned side-by-side.

Tweeters 32, 34 and 36 on tweeter baffle board 38 are arranged in such a manner that an oblique line 52 at an angle of 45° to floor 31 passes through the geometric centers of woofer/mid-range speaker unit 42 and center tweeter 34. A second oblique line 54 normal to first oblique line 52 and also at a 45° angle to floor 31 passes through the geometric centers of woofer/mid-range speaker unit 44 and center tweeter 34. Distance d 45 is the distance between the center line 50 of the tweeter array and the parallel center line 56 passing through woofer/mid-range speaker unit 44.

Figure 4:
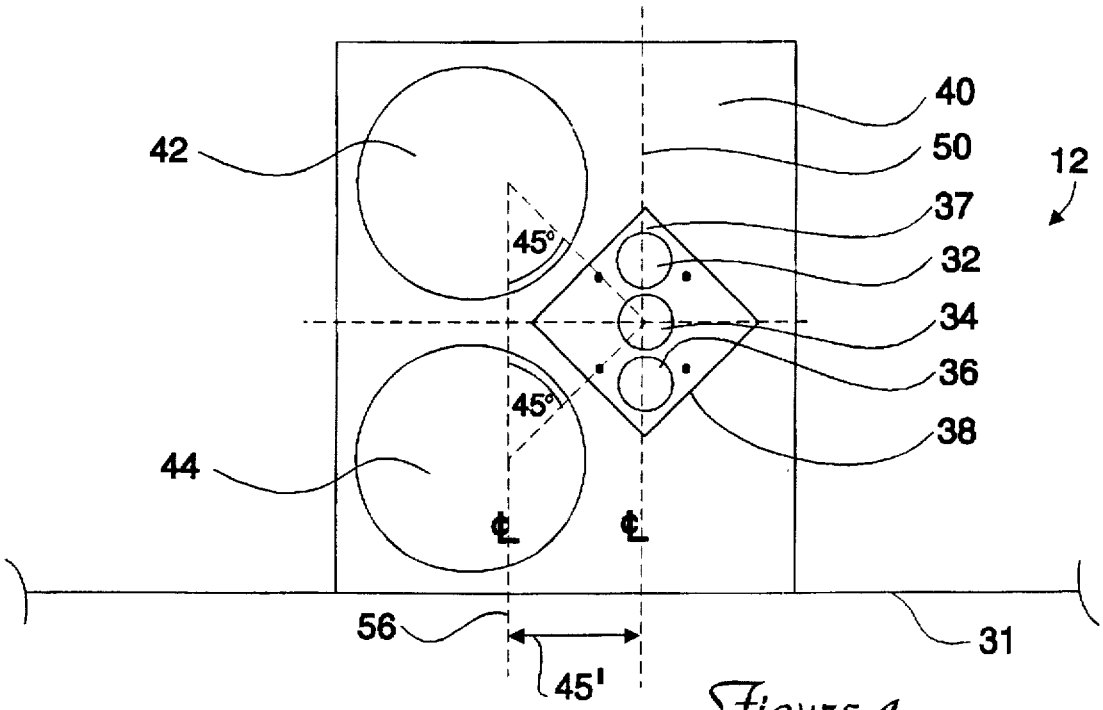
FIG. 4 is a plan view of the front of the speaker system of the present invention in a vertical deployment.

Referring now to FIG. 4, there is shown generally at reference numeral 12 one of the speaker systems of the present invention deployed in a vertical orientation. Its long axis (not shown) is perpendicular to floor 31. Tweeters 32, 34 and 36, mounted on tweeter baffle board 38, are shown reoriented, as hereinabove described, to maintain the tweeters on a vertical axis normal to floor 31. Woofer/mid-range speakers 42 and 44 are also shown fixedly attached to speaker baffle board 40.

As in the horizontal deployment of FIG. 3, the array 37 of tweeters 32, 34 and 36 is arranged in such a manner that oblique lines at an angle of 45° to floor 31 pass through the geometric centers of woofer/mid-range speaker units 42 and 44, respectively, and center tweeter 34. Again, distance d' 45' is the distance between the center line 50 of the tweeter array and the parallel center line 56 passing through woofer/mid-range speaker unit 44. A mounting geometry has been chosen, wherein distances d (FIG. 3) and d' are equal (due to the 45° angle).

The speaker system 12 (FIG. 4) and 14 (FIG. 3) of the present invention maintains the vertical orientation of the tweeter array 37, regardless of the horizontal or vertical deployment of the speaker systems. This is one of the invention's innovative features which ensures that the home-theater dispersion requirements are met, regardless of the horizontal or vertical deployment of the speaker systems. Maintaining the angular relationship and the center-to-center distances of the tweeters to the woofer/mid-range speaker units, respectively, is another important feature of the present invention. This relationship is important because, in frequency regions where a speaker unit operates independently, its dispersion is determined by the relationship of the size of the unit to the radiated wavelength (inverse of frequency). In frequency regions of transition from one speaker unit to another (cross-over regions), the physical separation of the two speaker units becomes the dominant factor controlling radiation patterns because of cancellation effects. For example, if each of two speaker units radiates a single frequency, sound waves from both speakers may be in phase at a listening position perpendicular to the mounting plane of the two speaker units. If a listener moves left or right from that listening position, the path length to each of the two speaker units changes, and the phase relationship of the two signals is altered. If path length difference becomes one-half wavelength, the phase difference between the two signals becomes 180° and total cancellation of the acoustical signal is experienced by the listener at that location. Consequently, the design of the present invention maintains the lateral spacing between the woofer and the woofer/mid-range unit as a constant, regardless of the orientation of the speaker system.

A novel electrical technique is also used to achieve the vertical radiation pattern depicted in FIG. 2. The electrical signals fed to outer tweeters 32 and 36 are rolled off. That is, the high-frequency content is attenuated with regard to the electrical signal fed to center tweeter 34. Roll-off begins at a frequency of approximately 4 kHz. Other speaker system designers have usually attempted to control vertical dispersion by using a pair of tweeters in a vertical array and relying on phase cancellation to reduce upward and downward radiation from the tweeter array. That approach lacks smoothness of frequency response and is difficult to control. Much smoother response and better control are achieved by using three tweeters in conjunction with an electrical network to control the vertical dispersion. With the selected roll-off and attenuation, the THX® specification is readily met.

Figure 5:
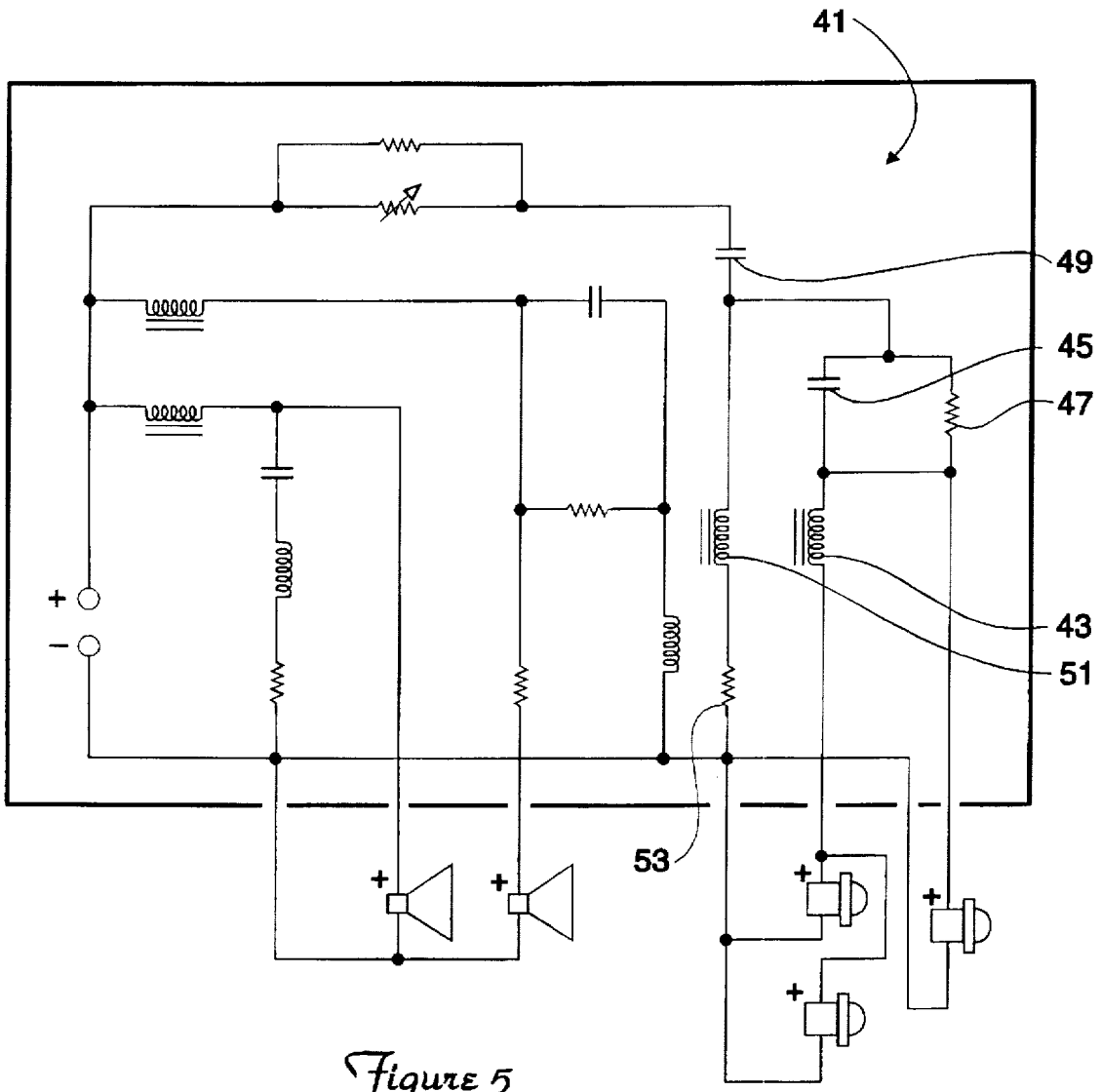
FIG. 5 is an electrical schematic diagram of the cross-over network of the present invention.

Referring now to FIG. 5, the cross-over network used in the speaker system of the present invention is shown generally at reference numeral 41. It should be understood that any suitable circuitry intended to provide the same or similar cross-over function can be used without departing from the scope of the present invention. Cross-over network 41 is used to operatively connect the woofer/mid-range speaker units 42 and 44 (FIGS. 3 and 4) and tweeters 32, 34 and 36 (FIGS. 3 and 4) to the appropriate frequency ranges of the electrical audio signal (not shown) being fed to the speaker system. Inductive device L6 43 is responsible for the high-frequency roll-off to outer tweeters 32 and 36 (FIGS. 3 and 4), as hereinabove described. In the preferred embodiment, an inductor 43 in series with the parallel combination of the two outer tweeters 32 and 36 (FIGS. 3 and 4) performs satisfactorily. The parallel combination of tweeters 32 and 36 and inductor 43 and tweeter 34 in parallel therewith, acting as a single high-frequency radiating unit with predetermined directional characteristics, is equalized by capacitor 45 and resistor 47 to a flat frequency response. Capacitor 49, inductor 51 and resistor 53 form a typical frequency dividing network well known in the art.

Figure 6:
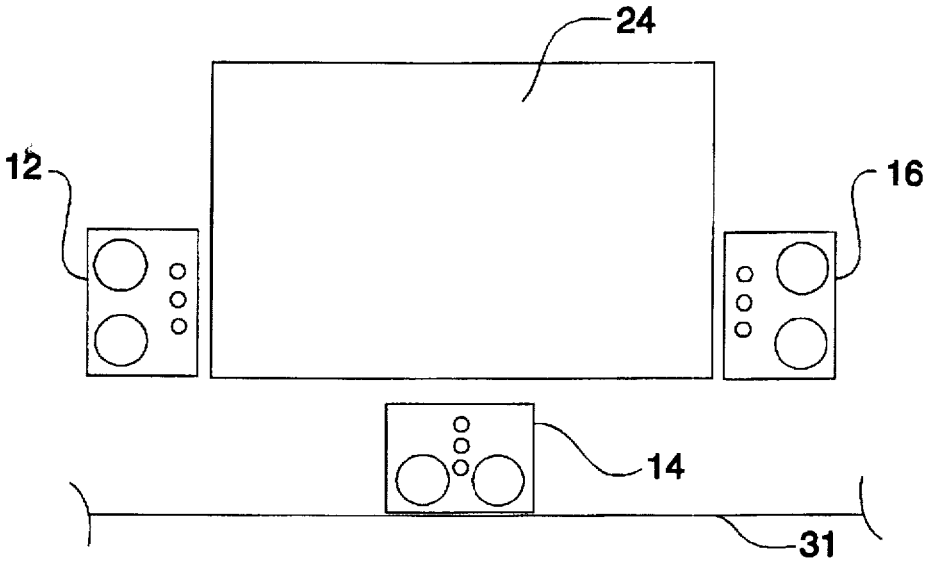
FIG. 6 is a plan view showing a projection screen and three speakers of the present invention installed in a typical home-theater viewing area.

Referring now to FIG. 6, there is shown a plan view of the speakers of the present invention in a typical home-theater arrangement. Projection screen 24 is shown with speaker systems 12 and 16 deployed in a vertical orientation at the left and right sides thereof, respectively. Speaker system 14 is shown deployed in a horizontal orientation on the floor beneath screen 24 and centered with respect thereto. The horizontal orientation reduces the profile of speaker system 14 and allows screen 24 to be located lower and/or be larger than would be possible with speaker system 14 deployed vertically. Because a single type of speaker system may be configurable for either horizontal or vertical deployment by the consumer, considerable savings by manufacturers and distributors may be realized. Also, in the event of speaker system failure, the user may choose to re-position the remaining speakers while awaiting repair or replacement of a failed speaker unit.

Figure 7:
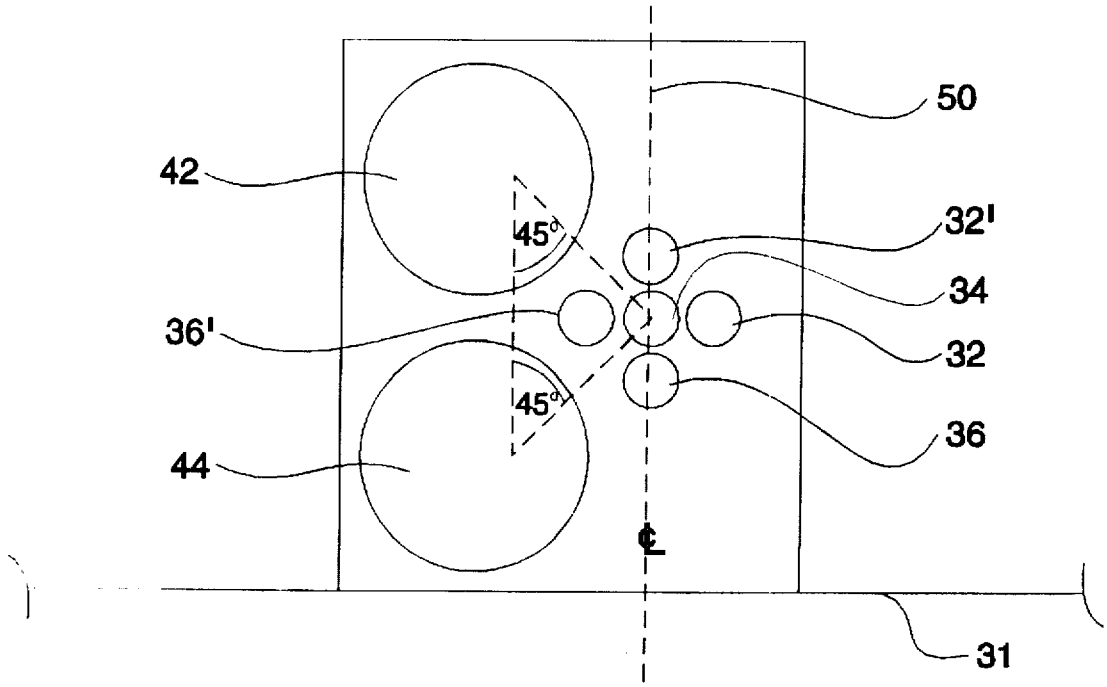
FIG. 7 is a plan view of an alternate embodiment of the speaker system of the present invention, shown in a vertical deployment.

Referring now to FIG. 7, there is shown an alternate embodiment of the present invention in a vertical orientation. The repositionable tweeter baffle board 37 (FIG. 4) has been eliminated. Tweeter units 32, 34 and 36 are fixedly mounted to the same baffle board as are woofer/mid-range speaker units 42 and 44; they comprise a three-tweeter vertical array behaving exactly as the vertical tweeter array of the preferred embodiment. Additional tweeter units 32' and 36' have been mounted on the baffle board but, in this orientation, are electrically disconnected and therefore inactive. An electrical switch (not shown) allows interchanging tweeters 32 and 32', as well as tweeters 36 and 36'.

Figure 8:
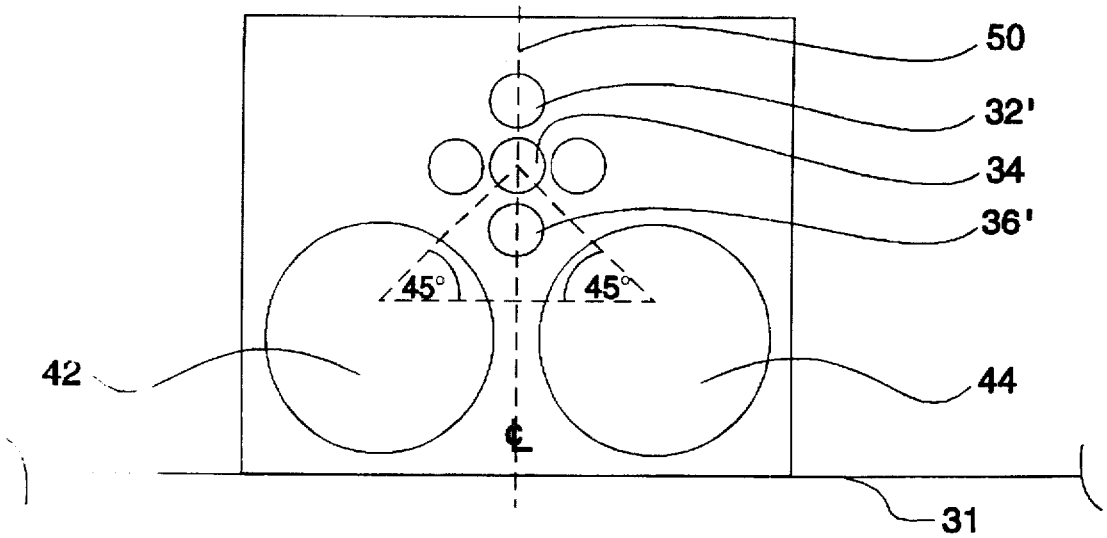
FIG. 8 is a plan view of the alternate embodiment of the speaker system of FIG. 7, shown in a horizontal deployment.

Referring now to FIG. 8, the alternate embodiment of FIG. 7 is now shown in a horizontal orientation. The electrical switch (not shown) connects 32' and 36', while disconnecting tweeters 32 and 36. A vertical tweeter array consisting of tweeter 32', 34 and 36' has now been formed. This new, "electrically rotated" tweeter array performs exactly as the tweeter array of the speaker disclosed in the description of the preferred embodiment and shown in FIG. 3.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An audio frequency sound source comprising:

a) a low-frequency speaker unit having a plane;

b) a directional, high-frequency speaker unit, said high-frequency speaker unit having two predetermined, distinct radiation patterns, one in the horizontal plane and one in the vertical plane; and c) means operatively connected to said high-frequency speaker unit for reorientation thereof substantially in said low frequency speaker unit lane, with respect to said low-frequency speaker unit.

2. The audio frequency sound source of claim 1, wherein said high-frequency speaker unit contains 2n+1 tweeters, where n=1, 2, 3, . . . .

3. The audio frequency sound source of claim 1, further comprising a mid-range speaker unit.

4. The audio frequency sound source of claim 1, wherein said high-frequency speaker unit comprises a horn.

5. The audio frequency sound source of claim 1, wherein said high-frequency speaker unit comprises a piezo-electric transducer.

6. The audio frequency sound source of claim 1, wherein said high-frequency speaker unit comprises an electrostatic transducer.

7. The audio frequency sound source of claim 1, wherein said high-frequency speaker unit comprises an array of dome tweeters.

8. The audio frequency sound source of claim 1, wherein said high-frequency speaker unit comprises an electrodynamic transducer.

9. The audio frequency sound source of claim 2, further comprising means for rolling off in frequency an electrical audio signal provided to at least one of said tweeters.

10. The audio frequency sound source of claim 2, wherein the electrical audio signal provided to at least one of said tweeters is lower in magnitude than the electrical audio signal provided to the remaining of said tweeters.

11. The audio frequency sound source of claim 2, wherein the electrical audio signal provided to at least one of said tweeters is phase-shifted relative to the electrical audio signal provided to the remaining of said tweeters.

12. The audio frequency sound source of claim 1, wherein said audio frequency sound source meets the frequency response, horizontal directivity, vertical directivity and power-handling requirements for THX-standard home theaters.

13. The audio frequency sound source of claim 2, wherein the line connecting the geometric center of the $(n+1)^{st}$ tweeter of said tweeters to the geometric center of said low-frequency speaker unit is substantially 45° relative to the vertical axis of said high-frequency speaker unit.

14. The audio frequency sound source of claim 1, wherein said directional, high-frequency speaker unit comprises an array of tweeters disposed upon at least two orthogonal axes and substantially in a plane with said low-frequency speaker unit.

15. The audio frequency sound source of claim 14, further comprising means for selectively providing signals to said array of tweeters.

16. The audio frequency sound source of claim 1, wherein said means for reorienting said directional, high-frequency speaker unit is mechanical.

17. The audio frequency sound source of claim 1, wherein said means for reorienting said directional, high-frequency speaker unit is electrical.

18. The audio frequency sound source of claim 1, wherein the line connecting the geometric center of said high-frequency speaker unit to the geometric center of said low-frequency speaker unit is angled substantially 45° relative to the vertical axis of said high-frequency speaker unit.

19. An audio frequency sound source comprising:

a) a low-frequency driver unit;

b) a tweeter array, being fixedly mounted on a tweeter baffle board, said tweeter array having two distinct radiation patterns, one in the horizontal plane and one in the vertical plane; and c) means operatively connected to said tweeter baffle board for rotation thereof relative to said low-frequency driver and substantially in the plane of said low-frequency driver.

20. The audio frequency sound source of claim 19, wherein said tweeter array contains 2n+1 tweeters, where n=1, 2, 3, . . . .

21. The audio frequency sound source of claim 20, further comprising means for rolling off in frequency an electrical audio signal provided to at least one of said tweeters.

22. The audio frequency sound source of claim, 21, wherein said audio frequency sound source meets the frequency response, horizontal directivity, vertical directivity and power-handling requirements for THX-standard home theaters.

* * * * *